US008950407B2

(12) United States Patent
Sebastian et al.

(10) Patent No.: US 8,950,407 B2
(45) Date of Patent: Feb. 10, 2015

(54) DEGRADABLE ADHESIVE COMPOSITIONS FOR SMOKING ARTICLES

(75) Inventors: Andries Don Sebastian, Clemmons, NC (US); Paul Stuart Chapman, Winston-Salem, NC (US); Robert Leslie Oglesby, Kernersville, NC (US); Robert Jeremy Pound, Kernersville, NC (US)

(73) Assignee: R.J. Reynolds Tobacco Company, Winston-Salem, NC (US)

( * ) Notice: Subject to any disclaimer, the term of this patent is extended or adjusted under 35 U.S.C. 154(b) by 332 days.

(21) Appl. No.: 13/051,058

(22) Filed: Mar. 18, 2011

(65) Prior Publication Data

US 2012/0000477 A1 Jan. 5, 2012

Related U.S. Application Data

(63) Continuation-in-part of application No. 12/827,618, filed on Jun. 30, 2010.

(51) Int. Cl.

| | |
|---|---|
| ***A24F 13/00*** | (2006.01) |
| ***A24F 17/00*** | (2006.01) |
| ***A24D 1/02*** | (2006.01) |
| ***A24D 3/06*** | (2006.01) |

(52) U.S. Cl.

CPC .. *A24D 1/02* (2013.01); *A24D 3/06* (2013.01); *A24D 3/068* (2013.01)

USPC ..... 131/329; 428/297.4; 428/343; 524/47; 493/39

(58) Field of Classification Search

None

See application file for complete search history.

(56) References Cited

U.S. PATENT DOCUMENTS

| | | | |
|---|---|---|---|
| 3,288,147 | A | 11/1966 | Molins et al. |
| 3,308,600 | A | 3/1967 | Erdmann et al. |
| 3,915,176 | A | 10/1975 | Heitmann et al. |
| 4,238,993 | A | 12/1980 | Brand et al. |
| 4,252,527 | A | 2/1981 | Hall |
| 4,280,187 | A | 7/1981 | Reuland et al. |
| 4,281,670 | A | 8/1981 | Heitmann et al. |

(Continued)

OTHER PUBLICATIONS

Verhulst et al., "Properties of Pressure Sensitive Adhesives Found in Paper Recycling Operations," *TAPPI Engineering Pulping and Environmental Conference Proceedings,* 2006, 7 Pages, Norcross, GA.

(Continued)

*Primary Examiner* — Richard Crispino
*Assistant Examiner* — Phu Nguyen
(74) *Attorney, Agent, or Firm* — Womble Carlyle Sandridge & Rice, LLP

(57) ABSTRACT

A filtered smoking article is provided, which includes a tobacco-containing rod surrounded by a wrapping material; a filter element surrounded by a plug wrap adjacent to the tobacco-containing rod; and a tipping material securing the tobacco-containing rod to the filter element, the tipping material overlying the plug wrap of the filter element and a portion of the wrapping material of the tobacco-containing rod, wherein at least one of the plug wrap, the tipping material, and the wrapping material surrounding the tobacco-containing rod are secured by an adhesive composition comprising a thermoplastic starch polymer. The adhesive composition can include a blend of the thermoplastic starch polymer with a second biodegradable polymer, such as polyvinyl alcohol, aliphatic polyesters, aliphatic polyurethanes, cis-polyisoprene, cis-polybutadiene, polyhydroxy alkanoates, polyanhydrides, and copolymers and blends thereof.

20 Claims, 5 Drawing Sheets

(56) References Cited

U.S. PATENT DOCUMENTS

| | | | | |
|---|---|---|---|---|
| 4,281,671 | A | 8/1981 | Bynre et al. | |
| 4,291,713 | A | 9/1981 | Frank | |
| 4,474,190 | A | 10/1984 | Brand | |
| 4,574,816 | A | 3/1986 | Rudszinat | |
| 4,807,809 | A | 2/1989 | Pryor et al. | |
| 4,850,301 | A | 7/1989 | Greene, Jr. et al. | |
| 4,862,905 | A | 9/1989 | Green, Jr. et al. | |
| 4,899,765 | A | 2/1990 | Davis et al. | |
| 5,012,823 | A | 5/1991 | Keritsis et al. | |
| 5,025,814 | A | 6/1991 | Raker | |
| 5,060,664 | A | 10/1991 | Siems et al. | |
| 5,060,665 | A | 10/1991 | Heitmann | |
| 5,121,758 | A | 6/1992 | Schmekel et al. | |
| 5,131,416 | A | 7/1992 | Gentry | |
| 5,135,008 | A | 8/1992 | Oesterling et al. | |
| 5,156,169 | A | 10/1992 | Holmes et al. | |
| 5,191,906 | A | 3/1993 | Myracle, Jr. | |
| 5,387,285 | A | 2/1995 | Rivers | |
| 5,453,144 | A | 9/1995 | Kauffman et al. | |
| 5,498,224 | A * | 3/1996 | Kauffman et al. | 493/39 |
| 5,709,227 | A | 1/1998 | Arzonico et al. | |
| 5,780,568 | A | 7/1998 | Vuorenpaa et al. | |
| 5,911,224 | A | 6/1999 | Berger | |
| 5,913,311 | A | 6/1999 | Ito et al. | |
| 5,947,126 | A | 9/1999 | Wilson et al. | |
| 5,970,988 | A | 10/1999 | Buchanan et al. | |
| 6,011,092 | A | 1/2000 | Seppälä et al. | |
| 6,021,782 | A | 2/2000 | Seymour et al. | |
| 6,062,228 | A | 5/2000 | Loercks et al. | |
| 6,135,386 | A | 10/2000 | Garthaffner | |
| 6,136,097 | A | 10/2000 | Lörcks et al. | |
| 6,229,115 | B1 | 5/2001 | Voss et al. | |
| 6,344,239 | B1 | 2/2002 | Asai et al. | |
| 6,369,215 | B1 | 4/2002 | Peltonen et al. | |
| 6,514,526 | B1 | 2/2003 | Forssell et al. | |
| 6,571,802 | B1 | 6/2003 | Yamashita | |
| 6,595,217 | B1 | 7/2003 | Case et al. | |
| 6,605,715 | B1 | 8/2003 | Lammers et al. | |
| 6,647,878 | B2 | 11/2003 | Blau et al. | |
| 6,780,903 | B2 | 8/2004 | Peltonen et al. | |
| 6,848,449 | B2 | 2/2005 | Kitao et al. | |
| 6,854,469 | B1 | 2/2005 | Hancock et al. | |
| 6,904,917 | B2 | 6/2005 | Kitao et al. | |
| 7,074,170 | B2 | 7/2006 | Lanier, Jr. et al. | |
| 7,237,557 | B2 | 7/2007 | Maiwald et al. | |
| 7,434,585 | B2 | 10/2008 | Holmes | |
| 7,435,208 | B2 | 10/2008 | Garthaffner | |
| 7,677,251 | B2 | 3/2010 | Barnes et al. | |
| 7,789,089 | B2 | 9/2010 | Dube et al. | |
| 2001/0039303 | A1 | 11/2001 | Loercks et al. | |
| 2003/0027007 | A1 | 2/2003 | Wieczorek, Jr. et al. | |
| 2003/0136419 | A1 | 7/2003 | Muller | |
| 2003/0145866 | A1 | 8/2003 | Hartmann | |
| 2004/0129281 | A1 | 7/2004 | Hancock et al. | |
| 2005/0039764 | A1 | 2/2005 | Barnes et al. | |
| 2005/0076929 | A1 | 4/2005 | Fitzgerald et al. | |
| 2005/0107603 | A1 | 5/2005 | Peltonen et al. | |
| 2005/0131081 | A1 | 6/2005 | Ueno et al. | |
| 2005/0170148 | A1 | 8/2005 | Mattila et al. | |
| 2005/0194014 | A1 | 9/2005 | Read | |
| 2006/0128889 | A1 | 6/2006 | Mikkonen et al. | |
| 2006/0137700 | A1 | 6/2006 | Gong et al. | |
| 2006/0169295 | A1 | 8/2006 | Draghetti | |
| 2007/0284034 | A1 | 12/2007 | Fathi et al. | |
| 2009/0247036 | A1 | 10/2009 | Shi et al. | |
| 2009/0255835 | A1 | 10/2009 | Pipes et al. | |
| 2009/0288669 | A1 | 11/2009 | Hutchens | |
| 2009/0293894 | A1 | 12/2009 | Cecchetto et al. | |
| 2009/0305592 | A1 | 12/2009 | Shi et al. | |
| 2010/0099543 | A1 | 4/2010 | Deal | |
| 2010/0108081 | A1 | 5/2010 | Blevins Joyce et al. | |
| 2010/0108084 | A1 | 5/2010 | Norman et al. | |
| 2010/0192962 | A1 | 8/2010 | Nelson et al. | |
| 2011/0030709 | A1 | 2/2011 | Sebastian et al. | |
| 2011/0036366 | A1 | 2/2011 | Sebastian | |

OTHER PUBLICATIONS

Zhu et al., "Preparation of Thermoplastic Starch and Investigation of the Properties," *China Academic Journal Electronic Publishing House*, www.cnki.net, 2006, pp. 28-31, 36, vol. 35, No. 2.

* cited by examiner

DEGRADABLE ADHESIVE COMPOSITIONS FOR SMOKING ARTICLES

CROSS REFERENCE TO RELATED APPLICATIONS

This application is a continuation-in-part of U.S. application Ser. No. 12/827,618, filed Jun. 30, 2010, which is incorporated by reference herein in its entirety.

FIELD OF THE INVENTION

The present invention relates to products made or derived from tobacco, or that otherwise incorporate tobacco, and are intended for human consumption. The invention is particularly directed to degradable components for use in adhesive compositions for smoking article wrapping materials.

BACKGROUND OF THE INVENTION

Popular smoking articles, such as cigarettes, have a substantially cylindrical rod-shaped structure and include a charge, roll or column of smokable material, such as shredded tobacco (e.g., in cut filler form), surrounded by a paper wrapper, thereby forming a so-called "smokable rod" or "tobacco rod." Normally, a cigarette has a cylindrical filter element aligned in an end-to-end relationship with the tobacco rod. Typically, a filter element comprises plasticized cellulose acetate tow circumscribed by a paper material known as "plug wrap." Certain filter elements can incorporate polyhydric alcohols. Typically, the filter element is attached to one end of the tobacco rod using a circumscribing wrapping material known as "tipping paper." It also has become desirable to perforate the tipping material and plug wrap, in order to provide dilution of drawn mainstream smoke with ambient air. Descriptions of cigarettes and the various components thereof are set forth in Tobacco Production, Chemistry and Technology, Davis et al. (Eds.) (1999). A cigarette is employed by a smoker by lighting one end thereof and burning the tobacco rod. The smoker then receives mainstream smoke into his/her mouth by drawing on the opposite end (e.g., the filter end) of the cigarette.

The discarded portion of the cigarette rod is primarily composed of the filter element, which typically consists of tightly-compacted and highly crimped cellulose acetate fibers bonded at their contact points and wrapped by plug wrap and tipping paper. The presence of the wrapping materials, the fiber-to-fiber bonding, and the compacted nature of conventional filter elements have a detrimental effect on the rate of degradation of cigarette filters in the environment. Unless the filter element is unwrapped and the fibers spread apart to increase exposure, biodegradation of the filter can take several years.

A number of approaches have been used in the art to promote an increased rate of degradation of filter elements. One approach involves incorporation of additives (e.g., water soluble cellulose materials, water soluble fiber bonding agents, photoactive pigments, or phosphoric acid) into the cellulose acetate material in order to accelerate polymer decomposition. See U.S. Pat. Nos. 5,913,311 to Ito et al.; 5,947,126 to Wilson et al.; 5,970,988 to Buchanan et al.; and 6,571,802 to Yamashita. In some cases, conventional cellulose acetate has been replaced with other materials, such as moisture disintegrative sheet materials, extruded starch materials, or polyvinyl alcohol. See U.S. Pat. Nos. 5,709,227 to Arzonico et al; 5,911,224 to Berger; 6,062,228 to Loercks et al.; and 6,595,217 to Case et al. Incorporation of slits into a filter element has been proposed for enhancing biodegradability, such as described in U.S. Pat. Nos. 5,947,126 to Wilson et al. and 7,435,208 to Garthaffner. U.S. Pat. No. 5,453,144 to Kauffman et al. describes use of a water sensitive hot melt adhesive to adhere the plug wrap in order to enhance biodegradability of the filter element upon exposure to water. U.S. Pat. No. 6,344,349 to Asai et al. proposes to replace conventional cellulose acetate filter elements with a filter element comprising a core of a fibrous or particulate cellulose material coated with a cellulose ester to enhance biodegradability. U.S. Pat. Appl. Pub. No. 2009/0288669 to Hutchens suggests incorporation of degradable fiber materials into a filter element.

There remains a need in the art for a filtered smoking article exhibiting enhanced environmental degradation properties, particularly where the smoking article can be manufactured with only minor modification of conventional smoking article production equipment.

SUMMARY OF THE INVENTION

In one aspect, the present invention relates to a smoking article, and in particular, a rod-shaped filtered smoking article (e.g., a filtered cigarette). The smoking article includes a lighting end (i.e., an upstream end) and a mouth end (i.e., a downstream end). A mouth end piece is located at the extreme mouth end of the smoking article, and the mouth end piece allows the smoking article to be placed in the mouth of the smoker to be drawn upon. The mouth end piece has the form of a filter element, which typically comprises a fibrous tow filter material. The smoking article also includes several wrapping materials. In particular, the smoking article includes a wrapping material surrounding the tobacco-containing rod and a plug wrap surrounding the filter element. Still further, a tipping material secures the tobacco-containing rod to the adjacent filter element, the tipping material overlying the plug wrap of the filter element and a portion of the wrapping material of the tobacco-containing rod. At least one of the plug wrap, the tipping material, and the wrapping material surrounding the tobacco-containing rod is secured by an adhesive composition comprising a thermoplastic starch polymer. The use of thermoplastic starch polymers in the adhesive compositions utilized in smoking articles can enhance degradation of the smoking article by causing relatively quick release of the adhesive bonds following disposal of the smoking article. As the adhesive bonds in a wrapping material degrade, the wrapping material will release from the underlying, enwrapped components of the smoking article, such as the filter element, which can facilitate greater exposure of the underlying components to the environment.

The form of the adhesive composition comprising the thermoplastic starch polymer can vary, and exemplary forms include hot melts and aqueous dispersions. In one embodiment, the thermoplastic starch polymer comprises about 30 to about 95 weight percent of starch and about 5 to about 55 weight percent of one or more plasticizers. The thermoplastic starch polymer can further comprise up to about 20 weight percent of one or more additional additives selected from the group consisting of dispersion aids and colloids. The amount of thermoplastic starch polymer in the adhesive composition can vary, but the adhesive composition typically comprises at least about 35 weight percent or at least about 45 weight percent of the thermoplastic starch polymer, based on the total weight of the adhesive composition.

Polymeric blends can be used in the adhesive compositions of the invention, including blends of the thermoplastic starch polymer and a second biodegradable polymer, such as polyvinyl alcohol, aliphatic polyesters, aliphatic polyurethanes, cis-polyisoprene, cis-polybutadiene, polyhydroxy alkanoates, polyanhydrides, and copolymers and blends thereof. The amount of polymer blend in the adhesive composition can vary, but the adhesive composition typically comprises at least about 40 weight percent or at least about 55 weight percent of the blend, based on the total weight of the adhesive composition.

The adhesive composition can include further ingredients in addition to the thermoplastic starch polymer and any polymer blending partners discussed above, and exemplary further ingredients include tackifying resins, waxes, antioxidants, UV stabilizers, pigments, dyes, biocides, flame retardants, antistatic agents, fillers, surfactants, anti-foaming agents, and combinations thereof.

In one particular embodiment, the adhesive composition secures the plug wrap and is in the form of a hot melt, wherein the hot melt comprises at least about 35 weight percent of the thermoplastic starch polymer. In another embodiment, the adhesive composition secures the tipping material and is in the form of an aqueous dispersion, wherein the aqueous dispersion comprises at least about 35 weight percent of the thermoplastic starch polymer.

The nature, form, or type of smoking article can vary. Exemplary smoking articles include those in the form of a cigarette or an aerosol-generating smoking article that does not combust tobacco to any significant degree.

In one advantageous embodiment, the invention provides a filtered smoking article, comprising: a tobacco-containing rod surrounded by a wrapping material; a filter element surrounded by a plug wrap adjacent to the tobacco-containing rod; and a tipping material securing the tobacco-containing rod to the filter element, the tipping material overlying the plug wrap of the filter element and a portion of the wrapping material of the tobacco-containing rod, wherein both the plug wrap and the tipping material are secured by an adhesive composition comprising at least about 35 weight percent of a thermoplastic starch polymer. The thermoplastic starch polymer can be blended with other polymers as noted above, and can be in the form of a hot melt or an aqueous dispersion.

BRIEF DESCRIPTION OF THE DRAWINGS

In order to assist the understanding of embodiments of the invention, reference will now be made to the appended drawings, which are not necessarily drawn to scale. The drawings are exemplary only, and should not be construed as limiting the invention.

DETAILED DESCRIPTION OF THE PREFERRED EMBODIMENTS

Figure 1:
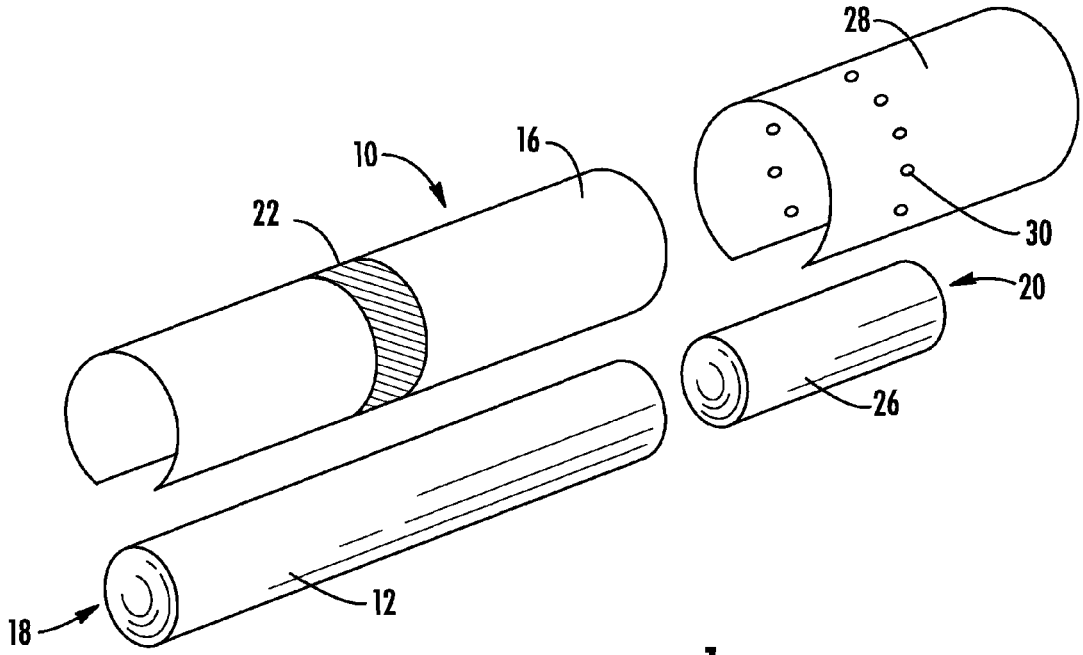
FIG. 1 is an exploded perspective view of a smoking article having the form of a cigarette, showing the smokable material, the wrapping material components, and the filter element of the cigarette.

The present inventions now will be described more fully hereinafter with reference to the accompanying drawing. The invention may be embodied in many different forms and should not be construed as limited to the embodiments set forth herein; rather, these embodiments are provided so that this disclosure will satisfy applicable legal requirements. Like numbers refer to like elements throughout. As used in this specification and the claims, the singular forms "a," "an," and "the" include plural referents unless the context clearly dictates otherwise.

The present invention provides adhesive compositions comprising at least one degradable material, such as a biodegradable polymer, suitable for adhering wrapping materials in a smoking article. Although the present disclosure focuses on use of such compositions to adhere plug wrap or tipping paper, certain embodiments of the adhesives of the invention could be used to adhere other wrapping materials used in smoking article manufacture, such as the wrapping material encasing a tobacco rod. Accordingly, the invention is applicable to any wrapping material or other component requiring adhesive used in the construction of smoking articles or other tobacco products that do not combust tobacco to any significant degree. The adhesive compositions of the invention could also find use in certain smokeless tobacco products, such as use for adhering seams of smokeless tobacco pouches or in other tobacco product packaging applications.

The use of degradable materials in adhesive compositions used to secure wrapping materials of smoking articles, such as cigarettes, can increase or enhance the degradability of the smoking article itself. Heretofore, conventional adhesive compositions used in smoking article manufacture comprise relatively non-degradable polymeric materials such as ethylene vinyl acetate.

In one aspect, the invention provides a plug wrap adhesive composition or tipping paper adhesive composition comprising a degradable polymer. In one embodiment, the biodegradable polymer is a thermoplastic starch polymer or a blend containing such a starch polymer. As used herein, "starch" or "starch polymer" refers to a is a polysaccharide-based carbohydrate polymer $(C_6H_{10}O_5)_n$ comprising glucose units joined together by glycosidic linkages, and can be characterized primarily as a mixture of linear (amylose) and branched (amylopectin) polymers. Amylose is essentially a linear polymer of $\alpha(1\rightarrow4)$ linked D-glucopyranosyl units. Amylopectin is a highly-branched polymer of D-glucopyranosyl units containing $\alpha(1\rightarrow4)$ linkages, with $\alpha(1\rightarrow6)$ linkages at the branch points. Naturally-occurring corn starch contains about 75% amylopectin (higher molecular weight branched starch polymer) and 25% amylose (lower molecular weight linear starch polymer), although hybrid corn starch products containing more than 50% amylose are sold by National Starch and Chemical Company Corporation and American Maize Products Company. The amount of amylose and amylopectin within the starch used in the present invention can vary, although the amylose content is typically about 5% to about 90% by weight with the remainder being amylopectin. Natural starch is a partially crystalline structure (e.g., about 15 to about 45% crystallinity) that is hydrophilic, with much of the swelling in water occurring in the amorphous sections of the molecule. Additional exemplary starch materials are described in U.S. Pat. Nos. 5,780,568 to Vuorenpaa et al.; 6,011,092 to Seppala et al.; 6,369,215 to Pletonen et al.; 6,514,526 to Forssell et al.; 6,605,715 to Lammers et al.; and 6,780,903 to Pletonen et al., and U.S. Pat. Appl. Pub. Nos. 2005/0107603 to Pletonen et al. and 2006/0128889 to Mikkonen et al., which are incorporated herein by reference in their entirety. Exemplary weight average molecular weight ranges for the starch material of the present invention can vary, but the molecular weight of the starch is typically in the range of about 1,000 to about 3,000,000 Da, often about 75,000 to about 1,000,000 Da, and more often about 150,000 to about 750,000 Da.

The starch may be used in its natural form (e.g., as extracted from one or more plants, or as purified by any method), in a destructured form, in any number of chemically modified derivative forms (e.g., hydroxyalkylated starch, starch esters, ionically modified starches including cationic starch derivatives and anionic starch derivatives, oxidized starches, plasticized starches, hydrolyzed starches, gelatinized starch, grafted starches, crosslinked starches, transglycosylated starches, starch ethers, or mixtures thereof). Certain modifications of starch increase hydrophobicity of the material, which can be done without departing from the invention. Although starch isolated and/or purified from any plant sources may be useful in the present invention, exemplary starch sources include corn, potato, tapioca, rice, oat, peas, sago, barley, wheat, cassava, and yam. Starches produced from any source and starches modified in any manner described herein are encompassed in the present invention.

The term "thermoplastic starch polymer" (also referred to as "TPS") refers to a starch polymer that is in melt-processable form, typically due to admixture of the starch or starch derivative (e.g., starch acetate or starch ester) with at least one plasticizer. The plasticizer can vary, and examples include various polyols (e.g., ethylene glycol, propylene glycol, or glycerol), sugars (e.g., glucose, sucrose, fructose, raffinose, maltodextrose, galactose, xylose, maltose, lactose, mannose, and erythrose), sugar alcohols (e.g., erythritol, xylitol, malitol, mannitol, and sorbitol), urea and urea derivatives, anhydrides of sugar alcohols such as sorbitan, gelatin, vegetable proteins, phthalate esters, dimethyl and diethylsuccinate and related esters, glycerol triacetate, various acid esters (e.g., lactic acid esters, citric acid esters, adipic acid esters, stearic acid esters, and oleic acid esters), and mixtures thereof.

A thermoplastic starch polymer can also include other optional components such as dispersion aids or protective colloids. Exemplary optional colloids include polyvinyl alcohol, alkyl ether dimer, beeswax, carnauba wax, and the like. Exemplary dispersion aids or surfactants include polyoxyethylene derivatives (e.g., polysorbates), saponin, alkyl sulfonates, alkyl benzene sulfonates, and the like. Additional information regarding thermoplastic starches can be found, for example, in U.S. Pat. Nos. 6,011,092 to Seppälä et al. and 6,136,097 to Lörcks et al; and U.S. Pat. Appl. Pub. Nos. 2009/0247036 and 2009/0305592 to Shi et al., all of which are incorporated by reference herein.

The relative amount of starch material, plasticizer, and optional additional components in a thermoplastic starch polymer composition can vary. Typically, a thermoplastic starch polymer will contain from about 30 weight percent to about 95 weight percent of starch (including bound water), from about 5 weight percent to about 55 weight percent of one or more plasticizers, and from about 0.01 weight percent to about 20 weight percent of any further optional components such as dispersion aids or protective colloids, based on the total weigh of the polymer composition.

Exemplary commercial embodiments of thermoplastic starch that could be used, or readily modified for use, in the present invention include BIOMAX® TPS available from DuPont, BIOPLAST TPS® available from Biotec GmbH, GETREX TP II available from IGV, PLANTIC® TPS available from Plantic Technologies Limited, RE-NEW 400 starch resin available from StarchTech, Inc., SOLANYL® BP available from Rodenburg Biopolymers B.V., CEREPLAST COMPOSTABLES® available from Cereplast, Inc., and BIOGRADE® TPS available from Biograde Ltd.

The TPS can be used as a singular polymer component in the adhesive composition or admixed with one or more additional polymer materials. When a polymer blend is used, the blending partners are also typically degradable. Exemplary biodegradable polymers that could be blended with TPS include polyvinyl alcohol, aliphatic polyesters, aliphatic polyurethanes, cis-polyisoprene, cis-polybutadiene, polyhydroxy alkanoates, polyanhydrides, and copolymers and blends thereof. The term "aliphatic polyester" refers to polymers having the structure —[C(O)—R—O]$_n$—, wherein n is an integer representing the number of monomer units in the polymer chain and R is an aliphatic hydrocarbon, preferably a C1-C10 alkylene, more preferably a C1-C6 alkylene (e.g., methylene, ethylene, propylene, isopropylene, butylene, isobutylene, and the like), wherein the alkylene group can be a straight chain or branched. Exemplary aliphatic polyesters include polyglycolic acid (PGA), polylactic acid (PLA) (e.g., poly(L-lactic acid) or poly(DL-lactic acid)), polyhydroxy butyrate (PHB), polyhydroxy valerate (PHV), polycaprolactone (PCL), and copolymers thereof. Other examples of polymers suitable for blending with a starch material include biodegradable thermoplastic polyesters such as Ecoflex® aliphatic-aromatic copolyester materials available from BASF Corporation or poly(ester urethane) polymers described in U.S. Pat. No. 6,087,465 to Seppälä et al., which is incorporated by reference herein in its entirety. Although relatively non-degradable synthetic polymers, such as certain aromatic polyesters (e.g., polyethylene terephthalate) or polyolefins (e.g., polyethylene, polypropylene), could also be used in a blend with TPS, the resulting adhesive composition would have decreased biodegradability.

Exemplary commercial embodiments of thermoplastic starch blends that could be used, or readily modified for use, in the present invention include BIOLICE® blends (starch material combined with ECOFLEX® copolyester polymer) available from Limagrain Céréales, BIOGRADE® blends (TPS and aliphatic polyester or polyvinyl alcohol) available from Biograde Ltd., CERELOY® blends (TPS and polyolefins) available from Cerestech, Inc., GB blend series (TPS and biodegradable polyester) available from Grace Biotech, MATER-BI® blends (TPS and polyvinyl alcohol) available from Novamont SpA, BIOCERES® blends (wheat flour and polyester) available from FuturaMat, CEREPLAST HYBRID RESINS® (starch and polyolefin) and CEREPLAST COMPOSTABLES® (TPS and polylactic acid) available from Cereplast, Inc., BIOPAR® blends (TPS and copolyester) available from BIOP Biopolymer Technologies AG, BIOPLAST® blends (TPS and aliphatic polyesters) available from Biotec GmbH, NOVON® blends (starch and copolyester, polycaprolactone or cellulose acetate) available from Warner-Lambert, and GREENPOL™ blends (starch and polycaprolactone) available from SK Corporation.

The relative amount of thermoplastic starch polymer or polymer blend comprising a thermoplastic starch polymer in the adhesive composition can vary. Typically, the TPS itself is present in the adhesive composition at a concentration of at least about 35 weight percent, often at least about 40 weight percent, and frequently at least about 45 weight percent, based on the total weight of the adhesive composition (e.g., at least about 50 weight percent or even at least about 55 weight percent). Where a polymer blend is used, such as a blend of TPS and a second biodegradable polymer, the concentration of the blend is typically at least about 40 weight percent, based on the total weight of the adhesive composition, and often at least about 50 weight percent or at least about 55 weight percent. In certain embodiments, polymer blend comprising a thermoplastic starch polymer accounts for at least about 65 weight percent of the adhesive or at least about 75 weight percent.

The adhesive composition can contain various further additives in addition to those mentioned in connection with thermoplastic starch polymers. Exemplary additives include tackifying resins (e.g., rosins, terpenes, aliphatic, cycloaliphatic or aromatic resins, hydrogenated hydrocarbon resins, and terpene-phenol resins), waxes, additional plasticizers (e.g., benzoates, phthalates, and paraffin oils), antioxidants and stabilizers (e.g. hindered phenols, butylated hydroxytoluene (BHT), phosphates, and hindered aromatic amines), UV stabilizers, pigments and dyes, biocides, flame retardants, antistatic agents, fillers (e.g., calcium carbonate, barium sulfate, talc, silica, carbon black, clays such as kaolin, and plant-derived fibrous materials such as cotton, wool, cedar, hemp, bamboo, kapok, or flax), surfactants, anti-foaming agents, and the like. Tackifying resins are typically used in an amount of about 0 to about 50 weight percent, based on the total weight of the adhesive composition. Waxes are typically used in an amount of about 0 to about 40 weight percent. The remaining types of additives are typically used in an amount of up to about 40 weight percent, often up to about 25 weight percent, and more often up to about 10 weight percent. Types of additives useful for adhesives used in cigarette manufacture are also described in U.S. Pat. No. 5,453,144 to Kauffman et al. and U.S. Pat. Appl. Pub. Nos. 2003/0027007 to Wieczorek, Jr. et al. and 2006/0137700 to Gong et al., all of which are incorporated by reference herein.

The adhesive composition comprising the thermoplastic starch polymer or polymer blend comprising a thermoplastic starch polymer can be used in a variety of forms depending on the application. For plug wrap adhesive compositions, a hot melt formulation is typically used. As used herein, hot melt refers to a polymeric adhesive composition that contains little or no solvent content and which is solid at room temperature and heated to form a liquid prior to application. For tipping paper adhesive compositions, an adhesive composition in the form of an aqueous dispersion is typically used. As used herein, an aqueous dispersion refers to a polymeric adhesive composition wherein one or more polymeric components are present as dispersed particles in water. Aqueous dispersion adhesives typically become tacky when heated due to evaporation of at least a portion of the aqueous solvent, and the temperature at which the adhesive becomes tacky is generally referred to as the activation temperature.

Many of the TPS and TPS-containing blends described above are commercially available in a form suitable for use as a hot melt adhesive. However, in certain embodiments, the commercially available TPS or TPS-containing blend can be modified by blending with additional plasticizers or tackifying agents prior to use as a hot melt adhesive. In certain embodiments of the invention, a thermoplastic starch containing adhesive composition is provided in hot melt form having a melting temperature of about 60° C. to about 150° C., more often about 65° C. to about 120° C., and most often about 70° C. to about 100° C. Viscosity of the hot melt adhesive of the invention within its application temperature range can vary, but is typically about 500 centipoise (cP) to about 50,000 cP, more often about 800 cP to about 5,000 cP, and most often about 1,000 cP to about 3,500 cP. In certain advantageous embodiments, the hot melt adhesive of the invention is capable of penetrating a paper substrate to form a functional fiber tearing or suction bond adequate to maintain the integrity of the adhesive bond for the expected life of the adhered components.

To form an aqueous dispersion containing a TPS or TPS-containing polymer blend, a commercially-available solid polymer product will sometimes require conversion to an aqueous dispersion form using any of a variety of techniques. For example, the polymer product can be first dissolved in a water-miscible organic solvent and precipitated into the form of a dispersion by mixing with water (i.e., a solvent-antisolvent approach). In another embodiment, a dispersion is formed by dissolving the polymer product in an organic solvent that is immiscible with water and then spraying the solution into heated water to immediately evaporate the organic solvent (i.e., evaporative precipitation). Finally, various types of equipment can be used to introduce shear into the polymer product to greatly reduce the particle size in order to prepare particles capable of dispersion in water. Exemplary particle size reduction techniques include wet ball milling (e.g., using a ball mill with zirconium dioxide beads, silicon nitride beads, or polystyrene beads), high pressure homogenization (e.g., forcing the polymer and an aqueous medium through a piston gap homogenizer), microfluidic particle size reduction, spray drying, and supercritical fluid particle size reduction.

In certain embodiments, an aqueous dispersion adhesive containing TPS is provided having an activation temperature of about 60° C. to about 150° C., more often about 65° C. to about 120° C., and most often about 70° C. to about 100° C. Viscosity of the aqueous dispersion of the invention at ambient temperature can vary, but is typically about 100 cP to about 10,000 cP, more often about 200 cP to about 5,000 cP, and most often about 300 cP to about 700 cP. Percent solids of the aqueous dispersion of the invention typically ranges from about 25% to about 60% solids, more often about 35% to about 55% solids, and most often about 47% to about 52% solids.

If rheology modifying dispersion aids are added to the aqueous dispersion, the viscosity of the aqueous dispersion and the percent solids of the aqueous dispersion could change. For such modified embodiments, the viscosity range is typically about 500 cP to about 10,000 cP, more often about 1,000 cP to about 5,000 cP, and most often about 2,500 cP to about 4,600 cP. In addition, for such modified embodiments, the percent solids range is typically about 25% to about 60% solids, more often about 35% to about 55% solids, and most often about 45% to about 50% solids. In certain advantageous embodiments, the aqueous dispersion adhesive of the invention is capable of penetrating a paper substrate to form a functional fiber tearing or suction bond adequate to maintain the integrity of the adhesive bond for the expected life of the adhered components.

In certain embodiments, the TPS or TPS-containing polymer blend used in the present invention can be characterized as degradable, meaning the polymer material is capable of undergoing degradation or decomposition, for example through chemical reaction that breaks down the particles into decomposition products, particularly under environmental conditions associated with disposal of a smoking article. Degradable materials include those materials classified as biodegradable and compostable. In certain embodiments, adhesive compositions of the invention that contain the TPS or TPS-containing polymer blend are also characterized as degradable, such as biodegradable and/or compostable.

As used herein, the term "biodegradable" refers to a material that degrades under aerobic and/or anaerobic conditions in the presence of bacteria, fungi, algae, and other microorganisms to carbon dioxide/methane, water and biomass, although materials containing heteroatoms can also yield other products such as ammonia or sulfur dioxide. "Biomass" generally refers to the portion of the metabolized materials incorporated into the cellular structure of the organisms present or converted to humus fractions indistinguishable from material of biological origin. The term "compostable" is generally used to refer to a material that degrades into carbon dioxide, water, inorganic compounds and biomass at a rate comparable to other known compostable materials, and which leaves no visible or toxic residue.

Degradability can be measured, for example, by placing a sample in environmental conditions expected to lead to decomposition, such as placing a sample in water, a microbe-containing solution, a compost material, or soil. The degree of degradation can be characterized by weight loss of the sample over a given period of exposure to the environmental conditions. Exemplary rates of degradation for certain adhesive embodiments of the invention include a weight loss of at least about 20% after burial in soil for 60 days or a weight loss of at least about 30% after 15 days of exposure to a typical municipal composter. However, rates of degradation can vary widely depending on the type of degradable particles used, the remaining composition of the filter element, and the environmental conditions associated with the degradation test. U.S. Pat. Nos. 5,970,988 to Buchanan et al. and 6,571,802 to Yamashita provide exemplary test conditions for degradation testing. The degradability of a plastic material also may be determined using one or more of the following ASTM test methods: D5338, D5526, D5988, and D6400.

The present invention is directed to use of the above-noted adhesive compositions during manufacture of smoking articles, particularly during manufacture of cigarettes comprising a plug wrap and tipping paper. Referring to FIG. 1, there is shown a smoking article 10 in the form of a cigarette and possessing certain representative components of a smoking article of the present invention. The cigarette 10 includes a generally cylindrical rod 12 of a charge or roll of smokable filler material contained in a circumscribing wrapping material 16. The rod 12 is conventionally referred to as a "tobacco rod." The ends of the tobacco rod 12 are open to expose the smokable filler material. The cigarette 10 is shown as having one optional band 22 (e.g., a printed coating including a film-forming agent, such as starch, ethylcellulose, or sodium alginate) applied to the wrapping material 16, and that band circumscribes the cigarette rod in a direction transverse to the longitudinal axis of the cigarette. That is, the band 22 provides a cross-directional region relative to the longitudinal axis of the cigarette. The band 22 can be printed on the inner surface of the wrapping material (i.e., facing the smokable filler material), or less preferably, on the outer surface of the wrapping material. Although the cigarette can possess a wrapping material having one optional band, the cigarette also can possess wrapping material having further optional spaced bands numbering two, three, or more.

At one end of the tobacco rod 12 is the lighting end 18, and at the mouth end 20 is positioned a filter element 26. The filter element 26 positioned adjacent one end of the tobacco rod 12 such that the filter element and tobacco rod are axially aligned in an end-to-end relationship, preferably abutting one another. Filter element 26 may have a generally cylindrical shape, and the diameter thereof may be essentially equal to the diameter of the tobacco rod. The ends of the filter element 26 permit the passage of air and smoke therethrough.

Figure 2:
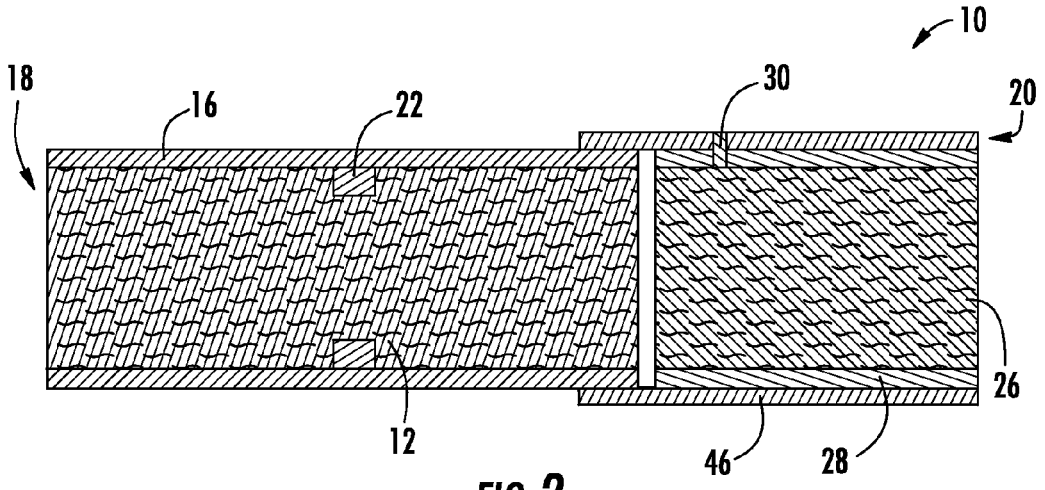
FIG. 2 is a cross-sectional view of a smoking article showing the various wrapping material components.

A cross-sectional view of a smoking article configured as shown in FIG. 1 is shown in FIG. 2. As shown therein, the filter element 26 is circumscribed along its outer circumference or longitudinal periphery by a layer of outer plug wrap 28. The plug wrap 28 is affixed to the filter element 26 using an adhesive composition according to the invention. Although only one section of filter material is shown in FIG. 2, other filter element configurations with multiple segments and/or cavities could be used without departing from the invention.

The filter element 26 is attached to the tobacco rod 12 using tipping material 46 that circumscribes both the entire length of the filter element 26 and an adjacent region of the tobacco rod 12. The inner surface of the tipping material 46 is fixedly secured to the outer surface of the plug wrap 28 and the outer surface of the wrapping material 16 of the tobacco rod, using an adhesive composition according to the invention, which affixes the filter element and the tobacco rod to one another. The tipping material 46 typically extends over the entire length of the filter element 26, and about 2 mm to about 6 mm, often about 3 mm to about 5 mm, and frequently about 4 mm over the length of the adjacent region of the tobacco rod 12.

A ventilated or air diluted smoking article can be provided with an optional air dilution means, such as a series of perforations 30, each of which extend through the tipping material and plug wrap. The optional perforations 30 can be made by various techniques known to those of ordinary skill in the art, such as laser perforation techniques. Alternatively, so-called off-line air dilution techniques can be used (e.g., through the use of porous paper plug wrap and pre-perforated tipping paper). For cigarettes that are air diluted or ventilated, the amount or degree of air dilution or ventilation can vary. Frequently, the amount of air dilution for an air diluted cigarette is greater than about 10 percent, generally is greater than about 20 percent, often is greater than about 30 percent, and sometimes is greater than about 40 percent. Typically, the upper level for air dilution for an air diluted cigarette is less than about 80 percent, and often is less than about 70 percent. As used herein, the term "air dilution" is the ratio (expressed as a percentage) of the volume of air drawn through the air dilution means to the total volume and air and smoke drawn through the cigarette and exiting the extreme mouth end portion of the cigarette.

The adhesive compositions of the invention can be incorporated into conventional cigarette manufacturing processes, particularly manufacturing processes configured to provide "two-up" cigarette rods. Although other manufacturing processes could be modified to use the adhesives of the invention, this disclosure will focus on two-up rod manufacturing processes.

Figure 3:
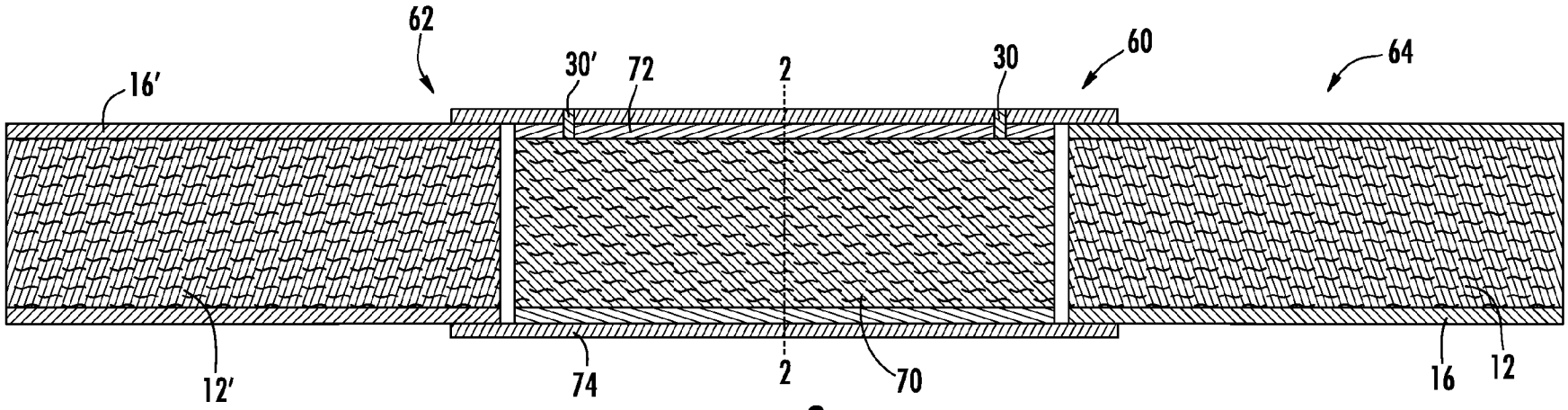
FIG. 3 is a cross-sectional view of a "two-up" cigarette rod prior to bifurcation during the cigarette manufacturing process.

Referring to FIG. 3, there is shown a representative two-up cigarette 60 that can be subdivided along hashed line 2-2 in order to provide two filtered cigarettes 62, 64 that each have the structure set forth in FIG. 2. To form a two-up cigarette 60, a two-up filter segment 70 is provided. The representative filter segment 70 comprises filter material and is circumscribed by plug wrap 72. Two tobacco rods 12, 12' are aligned at each end of the two-up filter segment to form a two-up cigarette rod. A layer of tipping material 74 (e.g., a so-called "patch" of tipping material) is wrapped around the aligned components, such that the tipping material circumscribes the entire length of the two-up filter segment 70, and a portion of the length of each tobacco rod 12, 12' in the respective regions thereof adjacent the filter segment. As such, a so called two-up cigarette 60 is provided. Optionally, that cigarette 60 can be air diluted (e.g., using laser perforation techniques) by applying at least one circumscribing ring of perforations 30, 30' through the tipping material 74 and the underlying plug wrap 72. If desired, additional layers of tipping material could be applied to form smoking articles with multiple layers of tipping material as described in U.S. Pat. No. 7,789,089 to Dube et al., which is incorporated by reference herein. The two-up combined filter segment 70 is ultimately cut in half along line 2-2 to provide two finished cigarettes 62, 64.

Figure 6:
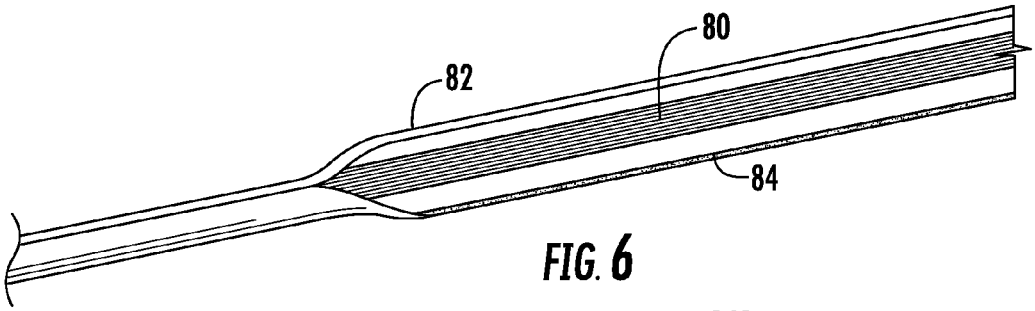
FIG. 6 is a perspective view of a plug wrap being applied to a continuous filter rod during manufacture of a smoking article.

To prepare a filter rod for two-up cigarette rod manufacture, as shown in FIG. 6, a continuous filter rod 80 of filter material is first formed, wrapped with plug wrap 82, and subdivided into smaller segments for use in the remainder of the manufacturing process. For example a continuous filter rod 80 can be subdivided into segments appropriately sized for use in a two-up manufacturing process. As illustrated in FIG. 6, adhesive 84 is applied to a seam of the plug wrap 82 so that the plug wrap will adhere to itself upon wrapping of the plug wrap around the continuous filter rod 80. Other regions of the plug wrap 82 could also be treated with the adhesive 84 without departing from the invention. For example, in certain embodiments, adhesive 84 is applied across the plug wrap 82 perpendicular to the longitudinal axis of the continuous filter rod 80 at certain intervals so that there is adhesive bonding directly to the continuous filter rod 80 at spaced locations. In addition, the filter rod 80 can be configured differently without departing from the invention, such as by incorporation of cavities, smoke-altering materials such as activated carbon, and the like.

Figure 8:
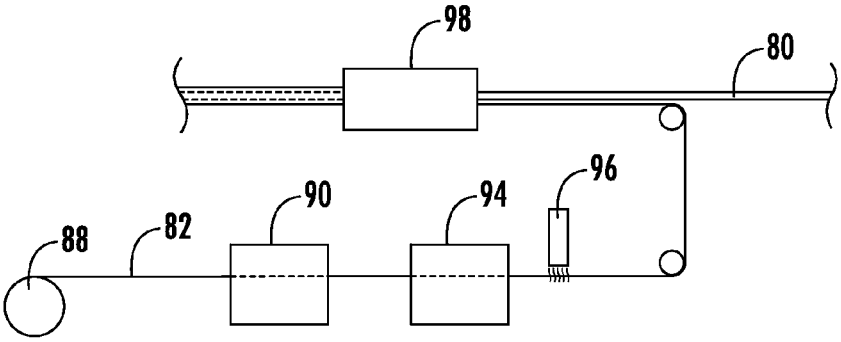
FIG. 8 is a schematic view of a portion of a filter rod manufacturing process illustrating application of an adhesive composition of the invention to a plug wrap and application of the plug wrap to a continuous filter rod.

FIG. 8 illustrates a simple schematic view of an apparatus for applying plug wrap adhesive to a continuous filter rod 80. As shown, plug wrap material 82 is supplied from roll 88 and passes through or by an adhesive applicator 90. The applicator 90 can be configured to apply adhesive in any manner and in any desired pattern. For example, the applicator 90 can apply the adhesive only to a seam along the edge of the plug wrap material 82 or can apply adhesive to any other desired location. Exemplary types of applicators 90 that can be used include applicators adapted for coating techniques such as knife-over-roll coating, reverse roll coating, gravure coating, metering rod coating, slot die coating, curtain coating, air knife coating, and the like. Since plug wrap adhesive is typically in the form of a hot melt, the applicator 90 is typically a system particularly adapted for delivery of hot melt adhesives, such as slot die or extrusion coating systems. Various methods for specific placement of continuous and discontinuous adhesive seams during manufacturing processes are commonly used. See, for example, U.S. Pat. Nos. 4,252,527 to Hall; 6,021,782 to Seymour et al.; and 7,237,557 to Maiwald et al.; and U.S. Pat. Appl. Pub. No. 2009/0255835 to Pipes et al., which are incorporated by reference herein.

Following application of the adhesive composition, the plug wrap 82 passes through an optional dryer 94, which may be unnecessary depending on the form of the adhesive. For hot melt adhesives, a drying system is typically not required. Where utilized, dryer 94 can comprise any known drying system or apparatus adapted to evaporate solvent from the adhesive coating, including conventional drying ovens. The dryer 94 can be designed to dry either opposed surface or both surfaces of plug wrap 82.

Following the optional drying operation, the plug wrap can be subjected to an optional microwave energy station 96 adapted to deliver microwave energy to the adhesive composition applied to the plug wrap 82. Microwave energy can enhance drying, activation or curing of the adhesive and can be used in addition to, or in lieu of, a conventional dryer 94 (e.g., a conventional conductive heating system). The use of microwave heating can provide shorter curing times and more efficient heating through the application of microwave energy tuned to the most efficient absorption frequencies for the adhesive material. Microwave energy heating is independent of the thermal conductivity of the material being heated. In conjunction with use of microwave energy, in certain embodiments, the adhesive composition of the invention is formulated with a polar additive, such as a salt material, to enhance the heating effect derived from the microwave energy. Exemplary microwave heating systems are available from Lambda Technologies of Morrisville, N.C. Microwave heating systems are also described in U.S. Pat. Appl. Pub. No. 2007/0284034 to Fathi et al., which is incorporated by reference herein. Although the microwave energy system 96 is shown positioned adjacent to one surface of the plug wrap 82, the microwave energy can be delivered to either side of the plug wrap or both sides if desired.

Following application of adhesive, the plug wrap 82 is placed in contact with the continuous filter rod 80 and wrapped around the filter rod in garniture 98. The presence of the adhesive causes the plug wrap to remain securely fastened around the filter rod 80. Although not shown in FIG. 8, the continuous filter rod is subdivided into smaller segments as desired following the wrapping process.

Plug wrap adhesive applied in hot melt form is typically applied through a heated nozzle at an application temperature of about 110° C. to about 160° C., and more often at an application temperature of about 120° C. to about 130° C. Flow rate of the adhesive is typically about 10 grams per minute measured at 500 meters per minute belt speed. Typically, line speed is about 225 to about 500 meters per minute belt speed, although in certain embodiments, belt speeds of approximately half of the normal speed can be used. A cooling bar (not shown) is typically provided to aid in setting the hot melt adhesive, and the temperature of the cooling bar is typically set to about 3° C. to about 5° C. Where an aqueous dispersion adhesive is used for the plug wrap, application of the adhesive would typically involve passing the adhesive through an extrusion nozzle at a flow rate of about 10 to about 12 grams per minute measured at a belt speed of about 500 meters per minute. Typically, line speeds would be less than about 250 meters per minute belt speed and a heated seal bar (not shown) can be used to aid setting of the aqueous dispersion adhesive.

Figure 4:
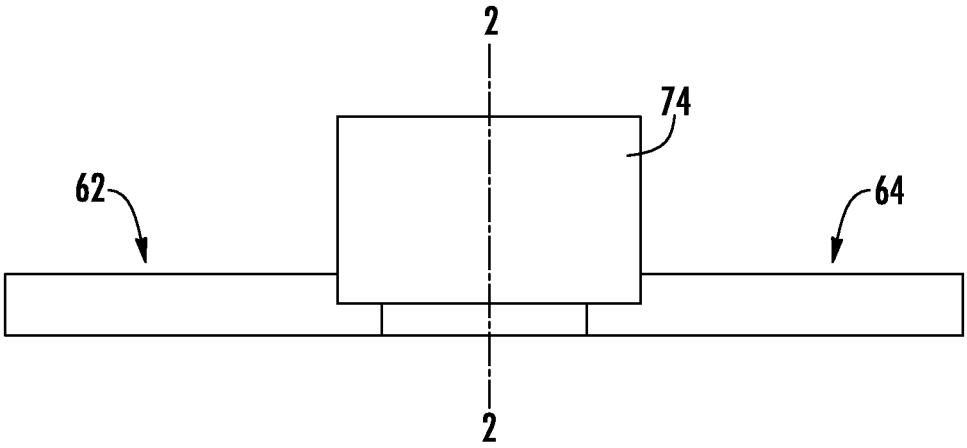
FIG. 4 illustrates a tipping material positioned for enwrapping a two-up cigarette rod.

In a two-up cigarette rod process, a two-up filter rod is positioned between two tobacco rods and a tipping material is wrapped around the combined rod. In FIG. 4, a tipping sheet or patch 74 is shown prior to being wrapped around a two-up rod that will be bifurcated along line 2-2 into two cigarettes 62, 64. Manners and methods for applying adhesives to tipping materials during automated cigarette manufacture will be apparent to those skilled in the art of cigarette design and manufacture. For example, a filtered cigarette can be tipped with a tipping material in an essentially traditional manner using a Lab MAX tipping device that is available from Hauni-Werke Korber & Co. KG.

Figure 5:
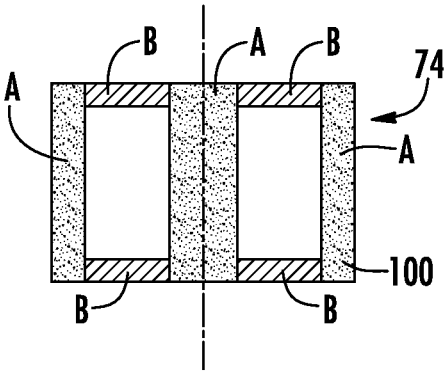
FIG. 5 illustrates exemplary regions where an adhesive composition according to the invention can be applied to the surface of a tipping material adapted for application to a two-up cigarette rod.

FIG. 5 illustrates exemplary locations where adhesive can be applied to tipping sheet 74. Any possible pattern of adhesive 100 can be applied to the tipping sheet 74 without departing from the invention including simply coating the entire underside of the sheet such that the entire side of the tipping sheet adheres to the two-up cigarette rod. Alternatively, the adhesive composition 100 can be applied to only discrete locations on the tipping sheet 74, as illustrated in FIG. 5. In the illustrated embodiment, adhesive 100 is applied to regions A, which ensure that the tipping material is secured at the extreme mouth end of the cigarette and at the end of the tipping material distal to the mouth end after bifurcation along line 2-2 of the two-up rod. In certain advantageous embodiments, the adhesive 100 is also applied in one or more of regions B, which protects against delamination or puckering of the tipping sheet 74 at the seam of the tipping sheet along the longitudinal axis of the cigarette.

Figure 7:
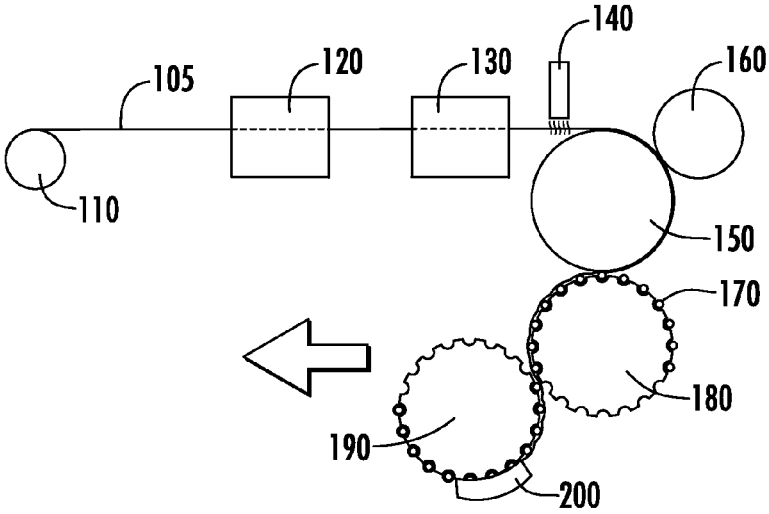
FIG. 7 is a schematic view of a portion of a cigarette manufacturing process illustrating application of an adhesive composition of the invention to a tipping material and application of the tipping material to a two-up cigarette rod.

FIG. 7 illustrates a partial schematic view of a two-up cigarette manufacturing process where a tipping paper sheet 74 is applied to the two-up rod. As shown, a tipping paper 105 is withdrawn from a roll 110 and passes through or by an adhesive applicator 120, which can be any of the types of applicators noted herein including applicators adapted for knife-over-roll coating, reverse roll coating, gravure coating, metering rod coating, slot die coating, curtain coating, air knife coating, and the like. Following the adhesive application station 120, the tipping paper 105 passes through or by an optional drying station 130, which can consist of any known drying apparatus in the art, such as conventional drying ovens. Whether the drying station is required will depend in part on the type and form of adhesive composition 100 used. Since tipping adhesive compositions 100 are typically used in aqueous dispersion form, heat activation through drying is normally part of the process. Accordingly, a dryer 130 would be expected where an aqueous dispersion adhesive is used. The dryer 130 can be designed to dry either or both surfaces of tipping paper 105. The process may also include an optional microwave energy station 140 adapted to deliver microwave energy to the adhesive composition 100 applied to the tipping material 105. The microwave energy system 140 can direct microwave energy to either or both sides of the tipping material 105 and is analogous to the microwave system previously described in connection with the plug wrap adhesive process.

Thereafter, the tipping paper 105 is directed onto a drum 150, which typically applies a suction force to the tipping paper, and the tipping paper passes rotary knife 160, where the paper material is sliced into individual tipping sheets or patches 74. The tipping sheets 74 then contacts unwrapped two-up cigarette rods 170 positioned in grooves of an adjacent rotating drum 180. Each two-up rod 170 and tipping sheet 74 are then passed to another drum 190, which brings the rods and tipping sheets into contact with a rolling apparatus 200 that rolls the tipping material around the two-up rod in order to complete the structure shown in FIG. 3. The resulting wrapped two-up rods are then subjected to further processing such as subdivision into individual cigarette rods (not shown).

Typically, an aqueous dispersion adhesive is applied to a tipping paper at ambient temperature using a metered applicator roller. Line speeds are generally about 7,500 to about 12,000 cigarettes per minute based on the machine and product being manufactured. Heat is often applied to the tipping roll hand at a temperature setting of about 100° C.

The filter material can vary, and can be any material of the type that can be employed for providing a tobacco smoke filter for cigarettes. Preferably a traditional cigarette filter material is used, such as cellulose acetate tow, gathered cellulose acetate web, polypropylene tow, gathered cellulose acetate web, gathered paper, strands of reconstituted tobacco, or the like. Especially preferred is filamentary or fibrous tow such as cellulose acetate, polyolefins such as polypropylene, or the like. One filter material that can provide a suitable filter rod is cellulose acetate tow having 3 denier per filament and 40,000 total denier. As another example, cellulose acetate tow having 3 denier per filament and 35,000 total denier can provide a suitable filter rod. As another example, cellulose acetate tow having 8 denier per filament and 40,000 total denier can provide a suitable filter rod. For further examples, see the types of filter materials set forth in U.S. Pat. Nos. 3,424,172 to Neurath; 4,811,745 to Cohen et al.; 4,925,602 to Hill et al.; 5,225,277 to Takegawa et al. and 5,271,419 to Arzonico et al.; each of which is incorporated herein by reference.

Normally a plasticizer such as triacetin or carbowax is applied to the filamentary tow in traditional amounts using known techniques. In one embodiment, the plasticizer component of the filter material comprises triacetin and carbowax in a 1:1 ratio by weight. The total amount of plasticizer is generally about 4 to about 20 percent by weight, preferably about 6 to about 12 percent by weight. Other suitable materials or additives used in connection with the construction of the filter element will be readily apparent to those skilled in the art of cigarette filter design and manufacture. See, for example, U.S. Pat. No. 5,387,285 to Rivers, which is incorporated herein by reference.

The tipping material can vary, and exemplary materials are the types conventionally used as tipping material in the manufacture of cigarettes. Typical tipping materials are papers exhibiting relatively high opacities. Representative tipping materials have TAPPI opacities of greater than about 81 percent, often in the range of about 84 percent to about 90 percent, and sometimes greater than about 90 percent. Typical tipping materials are printed with inks, typically nitrocellulose based, which can provide for a wide variety of appearances and "lip release" properties. Representative tipping papers materials have basis weights ranging from about 25 $m/m^2$ to about 60 $g/m^2$, often about 30 $g/m^2$ to about 40 $g/m^2$. Representative tipping papers are available as Tervakoski Reference Nos. 3121, 3124, TK 652, TK674, TK675, A360 and A362; and Schweitzer-Mauduit International Reference Nos. GSR270 and GSR265M2. See also, for example, the types of tipping materials, the methods for combining cigarette components using tipping materials, and techniques for wrapping various portions of cigarettes using tipping materials, that are set forth in US Pat. Appl. Pub. Nos. 2007/0215167 to Crooks et al. and 2009/0293894 to Cecchetto et al., which are incorporated by reference herein.

The material use for the plug wrap can vary, and can include either porous or non-porous paper material. Exemplary plug wrap papers ranging in porosity from about 1,100 CORESTA units to about 26,000 CORESTA units are available from Schweitzer-Maudit International as Porowrap 17-M1, 33-M1, 45-M1, 70-M9, 95-M9, 150-M4, 150-M9, 240M9S, 260-M4 and 260-M4T; and from Miquel-y-Costas as 22HP90 and 22HP150. Non-porous plug wrap materials typically exhibit porosities of less than about 40 CORESTA units, and often less than about 20 CORESTA units. Exemplary non-porous plug wrap papers are available from Olsany Facility (OP Paprina) of the Czech Republic as PW646; Wattenspapier of Austria as FY/33060; Miquel-y-Costas of Spain as 646; and Schweitzer-Mauduit International as MR650 and 180. Plug wrap paper can be coated, particularly on the surface that faces the filter material, with a layer of a film-forming material. Such a coating can be provided using a suitable polymeric film-forming agent (e.g., ethylcellulose, ethylcellulose mixed with calcium carbonate, nitrocellulose, nitrocellulose mixed with calcium carbonate, or a so-called lip release coating composition of the type commonly employed for cigarette manufacture). Alternatively, a plastic film (e.g., a polypropylene film) can be used as a plug wrap material. For example, non-porous polypropylene materials that are available as ZNA-20 and ZNA-25 from Treofan Germany GmbH & Co. KG can be employed as plug wrap materials. See also, for example, U.S. Pat. No. 4,174,719 to Martin, which is incorporated by reference.

The wrapping material used as the tipping material and the plug wrap also can be constructed using a diffuse material (e.g., a diffuse plug wrap or diffuse tipping material). In diffuse wrapping material embodiments, the diffusivity of the wrapping material will most preferably be similar to that of standard cigarette wrapping material such as, for example, the material 16 (e.g., a diffusivity of about 2 cm/sec, or a base porosity of about 15 to about 80 CORESTA) or similar materials of the type commonly used around a tobacco charge in a cigarette. Exemplary embodiments will have a single layer of diffuse tipping material and porous plug wrap. Diffuse wrapping material will be greater than 0 CORESTA and less than 100 CORESTA, with a preferred range between about 5 to about 80 CORESTA, and a diffusivity of at least about 1 cm/sec, preferably at least about 1.5 cm/sec. Diffusivity may be measured using techniques such as, for example, those disclosed in US Pat. Appl. Pub. No. 2005/0087202 to Norman et al., which is incorporated herein by reference. This differs significantly from typical tipping or plug wrap materials, which may provide little or no diffusivity (e.g., about 0 cm/sec, commonly less than about 1 cm/sec, or a base porosity of less than about 10 CORESTA).

For cigarette embodiments including diffuse wrapping material around the filter element, the wrapping material may be selected from a number of paper or paper-like materials. In one example, a typical wrapping material of the type commonly used to contain a tobacco charge may be used. Such a wrapping material will most preferably include a desirable diffusivity (e.g., sometimes greater than 1 cm/sec, preferably greater than about 1.5 cm/sec, often about 1 to about 3 cm/sec, and frequently about 2 cm/sec). Wrapping materials having a high degree of diffusivity are described in US Pat. Appl. Pub. No. 2010/0108084 to Norman et al., which is incorporated by reference herein in its entirety. Although not bound by any particular theory of operation, it is believed that the use of wrapping materials having a high degree of diffusivity may provide advantageous flow characteristics through the filter element.

Various types of cigarette components, including tobacco types, tobacco blends, top dressing and casing materials, blend packing densities and types of paper wrapping materials for tobacco rods, can be employed. See, for example, the various representative types of cigarette components, as well as the various cigarette designs, formats, configurations and characteristics, that are set forth in Johnson, Development of Cigarette Components to Meet Industry Needs, 52$^{nd}$ T.S.R.C. (September, 1998); U.S. Pat. Nos. 5,101,839 to Jakob et al.; 5,159,944 to Arzonico et al.; 5,220,930 to Gentry and 6,779,530 to Kraker; US Pat. Appl. Pub. Nos. 2005/0016556 to Ashcraft et al.; 2005/0066986 to Nestor et al.; 2005/0076929 to Fitzgerald et al.; 2006/0272655 to Thomas et al.; 2007/0056600 to Coleman, III et al.; and 2007/0246055 to Oglesby, each of which is incorporated herein by reference. Most preferably, the entire smokable rod is composed of smokable material (e.g., tobacco cut filler) and a layer of circumscribing outer wrapping material.

The adhesives of the present invention can also be used in filter elements or other components incorporated within aerosol-generating smoking articles that do not combust tobacco material to any significant degree, such as those set forth in U.S. Pat. Nos. 4,756,318 to Clearman et al.; 4,714,082 to Banerjee et al.; 4,771,795 to White et al.; 4,793,365 to Sensabaugh et al.; 4,989,619 to Clearman et al.; 4,917,128 to Clearman et al.; 4,961,438 to Korte; 4,966,171 to Serrano et al.; 4,969,476 to Bale et al.; 4,991,606 to Serrano et al.; 5,020,548 to Farrier et al.; 5,027,836 to Shannon et al.; 5,033,483 to Clearman et al.; 5,040,551 to Schlatter et al.; 5,050,621 to Creighton et al.; 5,052,413 to Baker et al.; 5,065,776 to Lawson; 5,076,296 to Nystrom et al.; 5,076,297 to Farrier et al.; 5,099,861 to Clearman et al.; 5,105,835 to Drewett et al.; 5,105,837 to Barnes et al.; 5,115,820 to Hauser et al.; 5,148,821 to Best et al.; 5,159,940 to Hayward et al.; 5,178,167 to Riggs et al.; 5,183,062 to Clearman et al.; 5,211,684 to Shannon et al.; 5,240,014 to Deevi et al.; 5,240,016 to Nichols et al.; 5,345,955 to Clearman et al.; 5,396,911 to Casey, III et al.; 5,551,451 to Riggs et al.; 5,595,577 to Bensalem et al.; 5,727,571 to Meiring et al.; 5,819,751 to Barnes et al.; 6,089,857 to Matsuura et al.; 6,095,152 to Beven et al; and 6,578,584 to Beven; and US Pat. Appl. Pub. Nos. 2010/0186757 to Crooks et al. and 2011/0041861 to Sebastian et al., which are incorporated herein by reference. Still further, filter elements of the present invention can be incorporated within the types of cigarettes that have been commercially marketed under the brand names "Premier" and "Eclipse" by R. J. Reynolds Tobacco Company. See, for example, those types of cigarettes described in Chemical and Biological Studies on New Cigarette Prototypes that Heat Instead of Burn Tobacco, R. J. Reynolds Tobacco Company Monograph (1988) and Inhalation Toxicology, 12:5, p. 1-58 (2000); which are incorporated herein by reference.

Cigarette rods typically are manufactured using a cigarette making machine, such as a conventional automated cigarette rod making machine. Exemplary cigarette rod making machines are of the type commercially available from Molins PLC or Hauni-Werke Korber & Co. KG. For example, cigarette rod making machines of the type known as MkX (commercially available from Molins PLC) or PROTOS (commercially available from Hauni-Werke Korber & Co. KG) can be employed. A description of a PROTOS cigarette making machine is provided in U.S. Pat. No. 4,474,190 to Brand, at col. 5, line 48 through col. 8, line 3, which is incorporated herein by reference. Types of equipment suitable for the manufacture of cigarettes also are set forth in U.S. Pat. Nos. 4,781,203 to La Hue; 4,844,100 to Holznagel; 5,131,416 to Gentry; 5,156,169 to Holmes et al.; 5,191,906 to Myracle, Jr. et al.; 6,647,870 to Blau et al.; 6,848,449 to Kitao et al.; 6,854,469 to Hancock et al; 6,904,917 to Kitao et al.; and 7,677,251 to Barnes et al.; and US Pat. Appl. Pub. Nos. 2003/0145866 to Hartman; 2004/0129281 to Hancock et al.; 2005/0039764 to Barnes et al.; and 2005/0076929 to Fitzgerald et al.; each of which is incorporated herein by reference.

The components and operation of conventional automated cigarette making machines will be readily apparent to those skilled in the art of cigarette making machinery design and operation. For example, descriptions of the components and operation of several types of chimneys, tobacco filler supply equipment, suction conveyor systems and garniture systems are set forth in U.S. Pat. Nos. 3,288,147 to Molins et al.; 3,915,176 to Heitmann et al.; 4,291,713 to Frank; 4,574,816 to Rudszinat; 4,736,754 to Heitmann et al. 4,878,506 to Pinck et al.; 4,899,765 to Davis et al.; 5,060,665 to Heitmann; 5,012,823 to Keritsis et al. and 6,360,751 to Fagg et al.; and US Pat. Appl. Pub. No. 2003/0136419 to Muller; each of which is incorporated herein by reference. The automated cigarette making machines of the type set forth herein provide a formed continuous cigarette rod or smokable rod that can be subdivided into formed smokable rods of desired lengths.

Components for filter elements for filtered cigarettes typically are provided from filter rods that are produced using traditional types of rod-forming units, such as those available as KDF-2 and KDF-3E from Hauni-Werke Korber & Co. KG. Typically, filter material, such as filter tow, is provided using a tow processing unit. An exemplary tow processing unit has been commercially available as E-60 supplied by Arjay Equipment Corp., Winston-Salem, N.C. Other exemplary tow processing units have been commercially available as AF-2, AF-3, and AF-4 from Hauni-Werke Korber & Co. KG. In addition, representative manners and methods for operating a filter material supply units and filter-making units are set forth in U.S. Pat. Nos. 4,281,671 to Byrne; 4,862,905 to Green, Jr. et al.; 5,060,664 to Siems et al.; 5,135,008 to Oesterling et al.; 5,387,285 to Rivers; and 7,074,170 to Lanier, Jr. et al.; and US Pat. Appl. Pub. Nos. 2010/0099543 to Deal and 2010/0192962 to Nelson et al., all of which are incorporated by reference. Other types of technologies for supplying filter materials to a filter rod-forming unit are set forth in U.S. Pat. Nos. 4,807,809 to Pryor et al. and 5,025,814 to Raker; which are also incorporated herein by reference.

Filter elements, or filter segment components of combination filters, typically are provided from filter rods that are manufactured using traditional types of cigarette filter rod making techniques. For example, so-called "six-up" filter rods, "four-up" filter rods and "two-up" filter rods that are of the general format and configuration conventionally used for the manufacture of filtered cigarettes can be handled using conventional-type or suitably modified cigarette rod handling devices, such as tipping devices available as Lab MAX, MAX, MAX S or MAX 80 from Hauni-Werke Korber & Co. KG. See, for example, the types of devices set forth in U.S. Pat. Nos. 3,308,600 to Erdmann et al.; 4,238,993 to Brand et al.; 4,281,670 to Heitmann et al.; 4,280,187 to Reuland et al.; 4,850,301 to Greene, Jr. et al.; 6,135,386 to Garthaffner; 6,229,115 to Voss et al.; and 7,434,585 to Holmes, and US Pat. Appl. Pub. Nos. 2005/1094014 to Read, Jr., and 2006/0169295 to Draghetti, each of which is incorporated herein by reference. The operation of those types of devices will be readily apparent to those skilled in the art of automated cigarette manufacture.

Cigarette filter rods can be used to provide multi-segment filter rods. Such multi-segment filter rods then can be employed for the production of filtered cigarettes possessing multi-segment filter elements. An example of a two-segment filter element is a filter element possessing a first cylindrical segment incorporating activated charcoal particles dispersed within cellulose acetate tow (e.g., a "dalmation" type of filter segment) at one end, and a second cylindrical segment that is produced from a filter rod produced essentially of flavored, plasticized cellulose acetate tow filter material at the other end. The production of multi-segment filter rods can be carried out using the types of rod-forming units that traditionally have been employed to provide multi-segment cigarette filter components. Multi-segment cigarette filter rods can be manufactured using a cigarette filter rod making device available under the brand name Mulfi from Hauni-Werke Korber & Co. KG of Hamburg, Germany. Representative types of filter designs and components, including representative types of segmented cigarette filters, are set forth in U.S. Pat. Nos. 4,920,990 to Lawrence et al.; 5,012,829 to Thesing et al.; 5,025,814 to Raker; 5,074,320 to Jones et al.; 5,105,838 to White et al.; 5,271,419 to Arzonico et al.; 5,360,023 to Blakley et al.; 5,396,909 to Gentry et al.; and 5,718,250 to Banerjee et al; US Pat. Appl. Pub. Nos. 2002/0166563 to Jupe et al.; 2004/0261807 to Dube et al.; 2005/0066981 to Crooks et al.; and 2007/0056600 to Coleman III, et al.; PCT Publication No. WO 03/009711 to Kim; and PCT Publication No. WO 03/047836 to Xue et al.; which are incorporated herein by reference.

The dimensions of a representative cigarette 10 can vary. Preferred cigarettes are rod-shaped, and can have diameters of about 7.5 mm (e.g., circumferences of about 20 mm to about 27 mm, often about 22.5 mm to about 25 mm); and can have total lengths of about 70 mm to about 120 mm, often about 80 mm to about 100 mm. The length of the filter element 30 can vary. Typical filter elements can have total lengths of about 15 mm to about 40 mm, often about 20 mm to about 35 mm. For a typical dual-segment filter element, the downstream or mouth end filter segment often has a length of about 10 mm to about 20 mm; and the upstream or tobacco rod end filter segment often has a length of about 10 mm to about 20 mm.

The length of the filter element of each cigarette can vary. Typically, the overall length of a filter element is about 20 mm to about 40 mm, and often about 25 mm to about 35 mm. For a typical dual-segment filter element, the downstream or mouth end filter segment often has a length of about 10 mm to about 20 mm; and the upstream or tobacco rod end filter segment often has a length of about 10 mm to about 20 mm.

Preferred cigarettes of the present invention exhibit desirable resistance to draw. For example, an exemplary cigarette exhibits a pressure drop of between about 50 and about 200 mm water pressure drop at 17.5 cc/sec. air flow. Preferred cigarettes exhibit pressure drop values of between about 60 mm and about 180, more preferably between about 70 mm to about 150 mm, water pressure drop at 17.5 cc/sec. air flow. Typically, pressure drop values of cigarettes are measured using a Filtrona Cigarette Test Station (CTS Series) available form Filtrona Instruments and Automation Ltd.

Many modifications and other embodiments of the invention will come to mind to one skilled in the art to which this invention pertains having the benefit of the teachings presented in the foregoing description; and it will be apparent to those skilled in the art that variations and modifications of the present invention can be made without departing from the scope or spirit of the invention. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A filtered smoking article, comprising:

a tobacco-containing rod surrounded by a wrapping material;

a filter element surrounded by a plug wrap adjacent to the tobacco-containing rod; and a tipping material securing the tobacco-containing rod to the filter element, the tipping material overlying the plug wrap of the filter element and a portion of the wrapping material of the tobacco-containing rod, wherein at least one of the plug wrap, the tipping material, and the wrapping material surrounding the tobacco-containing rod are secured by an adhesive composition in the form of an aqueous dispersion comprising a thermoplastic starch polymer.

2. The filtered smoking article of claim 1, wherein the thermoplastic starch polymer comprises about 30 to about 95 weight percent of starch and about 5 to about 55 weight percent of one or more plasticizers.

3. The filtered smoking article of claim 1, wherein the thermoplastic starch polymer further comprises up to about 20 weight percent of one or more additional additives selected from the group consisting of dispersion aids and colloids.

4. The filtered smoking article of claim 1, wherein the adhesive composition comprises a blend of the thermoplastic starch polymer and a second biodegradable polymer.

5. The filtered smoking article of claim 4, wherein the second biodegradable polymer is selected from the group consisting of polyvinyl alcohol, aliphatic polyesters, aliphatic polyurethanes, cis-polyisoprene, cis-polybutadiene, polyhydroxy alkanoates, polyanhydrides, and copolymers and blends thereof.

6. The filtered smoking article of claim 4, wherein the adhesive composition comprises at least about 40 weight percent of the blend, based on the total weight of the adhesive composition.

7. The filtered smoking article of claim 4, wherein the adhesive composition comprises at least about 55 weight percent of the blend, based on the total weight of the adhesive composition.

8. The filtered smoking article of claim 1, wherein the adhesive composition comprises at least about 35 weight percent of the thermoplastic starch polymer, based on the total weight of the adhesive composition.

9. The filtered smoking article of claim 1, wherein the adhesive composition comprises at least about 45 weight percent of the thermoplastic starch polymer, based on the total weight of the adhesive composition.

10. The filtered smoking article of claim 1, wherein the adhesive composition comprises one more additives selected from the group consisting of tackifying resins, waxes, antioxidants, UV stabilizers, pigments, dyes, biocides, flame retardants, antistatic agents, fillers, surfactants, anti-foaming agents, and combinations thereof.

11. The filtered smoking article of claim 1, further comprising an adhesive composition in the form of a hot melt securing the plug wrap, wherein the adhesive composition in the form of a hot melt comprises at least about 35 weight percent of a thermoplastic starch polymer.

12. The filtered smoking article of claim 1, wherein the adhesive composition secures the tipping material, wherein the aqueous dispersion comprises at least about 35 weight percent of the thermoplastic starch polymer.

13. The filtered smoking article of claim 1, wherein the smoking article is in the form of a cigarette or an aerosol-generating smoking article that does not combust tobacco.

14. The filtered smoking article of claim 1, wherein both the plug wrap and the tipping material are secured by an adhesive composition comprising at least about 35 weight percent of a thermoplastic starch polymer.

15. The filtered smoking article of claim 14, wherein the adhesive composition comprises a blend of the thermoplastic starch polymer and a second biodegradable polymer.

16. The filtered smoking article of claim 15, wherein the second biodegradable polymer is selected from the group consisting of polyvinyl alcohol, aliphatic polyesters, aliphatic polyurethanes, cis-polyisoprene, cis-polybutadiene, polyhydroxy alkanoates, polyanhydrides, and copolymers and blends thereof.

17. The filtered smoking article of claim 14, wherein the thermoplastic starch polymer comprises about 30 to about 95 weight percent of starch and about 5 to about 55 weight percent of one or more plasticizers.

18. The filtered smoking article of claim 1, wherein the adhesive composition in the form of an aqueous dispersion has an activation temperature of about 60° C. to about 150° C.

19. The filtered smoking article of claim 1, wherein the adhesive composition in the form of an aqueous dispersion has a viscosity of about 100 cP to about 10,000 cP at ambient temperature.

20. The filtered smoking article of claim 1, wherein the adhesive composition in the form of an aqueous dispersion has a percent solids of about 25% to about 60% solids.

* * * * *